US005263863A

United States Patent [19]

Stefani et al.

[11] Patent Number: 5,263,863

[45] Date of Patent: Nov. 23, 1993

[54] WEIGHT SHIFT TRAINER FOR GOLFERS

[76] Inventors: Nicholas J. Stefani, 15219 Plantation Oaks Dr., Apt. 5, Tampa, Fla. 33647; James M. Torba, 17815A Jamestown Way, Lutz, Fla. 33549

[21] Appl. No.: 967,216

[22] Filed: Oct. 27, 1992

[51] Int. Cl.[5] ..... A63B 69/36

[52] U.S. Cl. ..... 434/252; 273/176 H; 273/176 F; 273/195 B

[58] Field of Search ..... 434/252; 273/176 H, 273/176 F, 195 B, 195 R

[56] References Cited

U.S. PATENT DOCUMENTS

| | | | |
|---|---|---|---|
| 3,101,949 | 8/1963 | Williams | 434/252 X |
| 3,352,559 | 11/1967 | Larsen | 273/195 R |
| 4,088,325 | 5/1978 | Sutton | 273/195 B X |
| 5,005,837 | 4/1991 | Urra Martinez | 273/176 H X |

FOREIGN PATENT DOCUMENTS

| | | | |
|---|---|---|---|
| 2238250 | 5/1991 | United Kingdom | 273/159 B |

*Primary Examiner*—Gene Mancene
*Assistant Examiner*—L. Thomas
*Attorney, Agent, or Firm*—Pettis & MacDonald

[57] ABSTRACT

A training device for training golfers the proper movement of the lower body during the golfing swing. The device comprises a base with a first foot pad and a second foot pad supported thereon, one of the foot pads being movable toward or away from the other foot pad. Each foot pad has a support surface upon which one foot of the golfer is placed. The support surface of the first foot pad is rotatable only from a horizontal position to an inwardly-facing position in relation to the second foot pad and the support surface of the second foot pad forms a predetermined angle with the base.

11 Claims, 2 Drawing Sheets

Fig 2
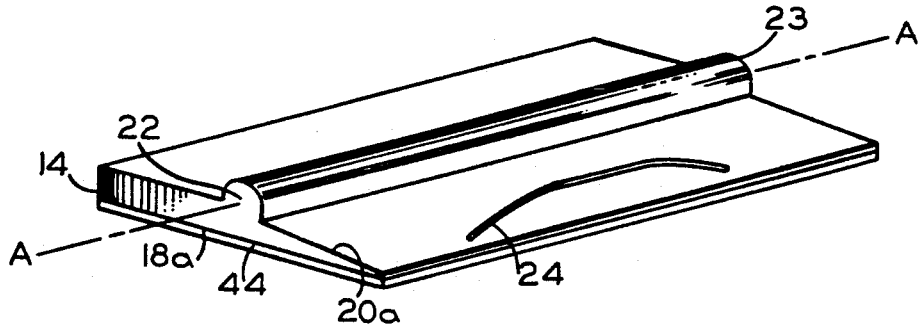
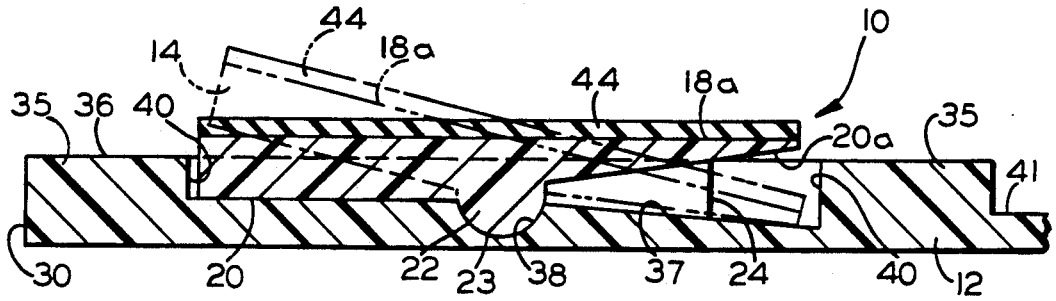
Fig 3
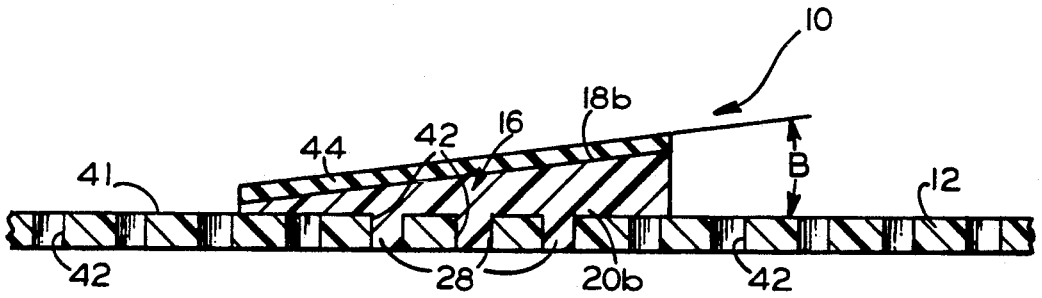
Fig 4

WEIGHT SHIFT TRAINER FOR GOLFERS

BACKGROUND OF THE INVENTION

1. Field of the Invention

The present invention relates to a training device for golfers, more particularly a trainer for teaching the proper motion of the lower body during the golfer's swing.

2. Description of the Prior Art

Many devices have been developed to teach golfers the techniques of the game. Some of these devices demonstrate the proper positioning of the feet in relation to the target and to the One such device is U.S. Pat. No. 5,083,789 issued to Hixon. The purpose of this device is to teach the spacing between the feet as well as a turning outward of the lead foot to provide an open stance.

Teaching the proper movement of the body, has been found to be very difficult, as explanations and demonstrations do not provide the student with a feel for the proper motion of a correct golf stroke. A very effective teaching technique is by repetition of the correct motion with the student feeling the proper movement of the body over and over again. Lower body movement is the base upon which the rest of the swing is established to maintain consistency and to develop power. Students frequently have bad habits or incorrect learned motions that must be overcome requiring a lot of repetition to retrain the golfer's conditioned motor skills or muscle memory.

Teaching aids have been developed to teach proper movement, but many devices are structured to permit improper movement as well as proper movement. Some of these devices provide the golfer with a signal when the improper movement is made. One such device is a pair of support plates upon which the golfer stands. The lead foot rotates in both directions, while the support plate supporting the back foot remains horizontal. The lead foot is permitted to rotate inwardly toward the back foot and outwardly away from the back foot about the longitudinal axis of the foot plate. A buzzer sounds when rotation occurs in either direction. The lead foot plate may also be locked so that it remains horizontal or so that it rotates only inwardly. Two patents issued to Lorang, U.S. Pat. Nos. 4,023,810 and 4,037,847 disclose a similar device having a pair of foot plates, but in this case, both foot plates rotate about the longitudinal axis of the foot plate. When the lead foot rotates outwardly a signal sounds and when the back foot plate rotates outwardly a signal is sounded. Effective golf training relies upon the student learning the feel of the proper movement. These devices permit improper movement which reinforces within the subconscious and within the "muscle memory⇄ this improper movement.

Just as there are different opinions as to the proper movement of the body during a golf swing, there are devices that teach movement that is contrary to that taught by others. In particular, U.S Pat. No. 3,955,821 issued to Spedding teaches a device that permits only outward rotation of the lead foot rest and a rear foot rest with a predetermined inward slant. The outward movement of the lead foot rest is contrary to the current invention.

It is clear that there remains a need for a device that teaches only the correct movement for the lower body in order to take advantage of the effective teaching technique of repetition so that the correct movement is ingrained into the subconscious or "muscle memory".

SUMMARY OF THE INVENTION

The present invention relates to a training device for golfers that is portable and easily used in an indoor or outdoor setting. The device is comprised of a base, a first foot pad that is operatively supported on the base, and a second foot pad that is supported on the base in a spaced-apart relation to the first foot pad. At least one of the foot pads is movable in relation to the base toward or away from the other foot pad. The foot pads are sized, configured and spaced apart such that the foot pads will support a person placing a foot on a respective foot pad. Each foot pad has a support surface supporting one foot of the golfer. Each support surface has a center line that generally corresponds to a line running from the heel to the middle toe of the person's foot when the foot is generally centered upon the pad. The first foot pad, that supports the lead foot (the foot closest to the target) of the golfer, is rotatable about a longitudinal axis that is generally parallel to the center line of the foot pad. The first foot pad is rotatable only between a generally horizontal position and a predetermined maximum inwardly facing position in relation to the second foot pad. The support surface of the second foot pad is fixed at a predetermined angle in relation to the base, facing inwardly in relation to the first foot pad.

This device is designed to allow golfers to feel the proper weight transfer that occurs during a correct golf swing. To use the training device, the foot pads are suitably spaced apart to correspond with the proper stance of the particular golfer. The golfer's lead foot is placed on the support surface of the first foot pad and the golfer's rear foot is placed on the support surface of the second foot pad. Each foot is placed on its respective foot pad such that a line running from the golfer's heel to the golfer's middle toe generally coincides with the center line of the support surface of the foot pad. At the set up position, with the club positioned behind a ball, the weight of the golfer is generally evenly distributed between both feet. As the golfer begins the back swing a portion of the weight on the lead foot is transferred to the back foot causing the left knee to break inwardly and the lead foot to roll inwardly. The training device encourages the correct weight transfer by allowing the first foot pad to rotate inwardly so that the weight remaining on the lead foot rests on the inside of the ball of that foot. The second foot pad, or back foot pad, is slanted inwardly at a predetermined angle to discourage the golfer from transferring weight beyond the inside of the back foot. Allowing weight to transfer beyond the inside of the back foot causes swaying in the back swing, which is to be avoided. By returning the lead foot pad to the horizontal position and then pushing off the angled back foot pad, the golfer executes a proper weight transfer for the forward swing. By practicing these motions repeatedly, the golfer learns the correct lower body motion for effective weight transfer and ingrains this proper movement into the subconscious as a part of the golfer's conditioned motor skills.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 2 is a perspective view of the bottom of the first foot pad of the training device shown in FIG. 1;

FIG. 3 is a partial cross-sectional view taken along line 3—3 of FIG. 1 illustrating the first foot pad in the horizontal position, and illustrating in phantom the fully inwardly rotated position; and FIG. 4 is a partial cross-section view taken along line 4—4 of FIG. 1.

Similar reference characters refer to similar parts throughout the several views of the drawings.

DETAILED DESCRIPTION

Figure 1:
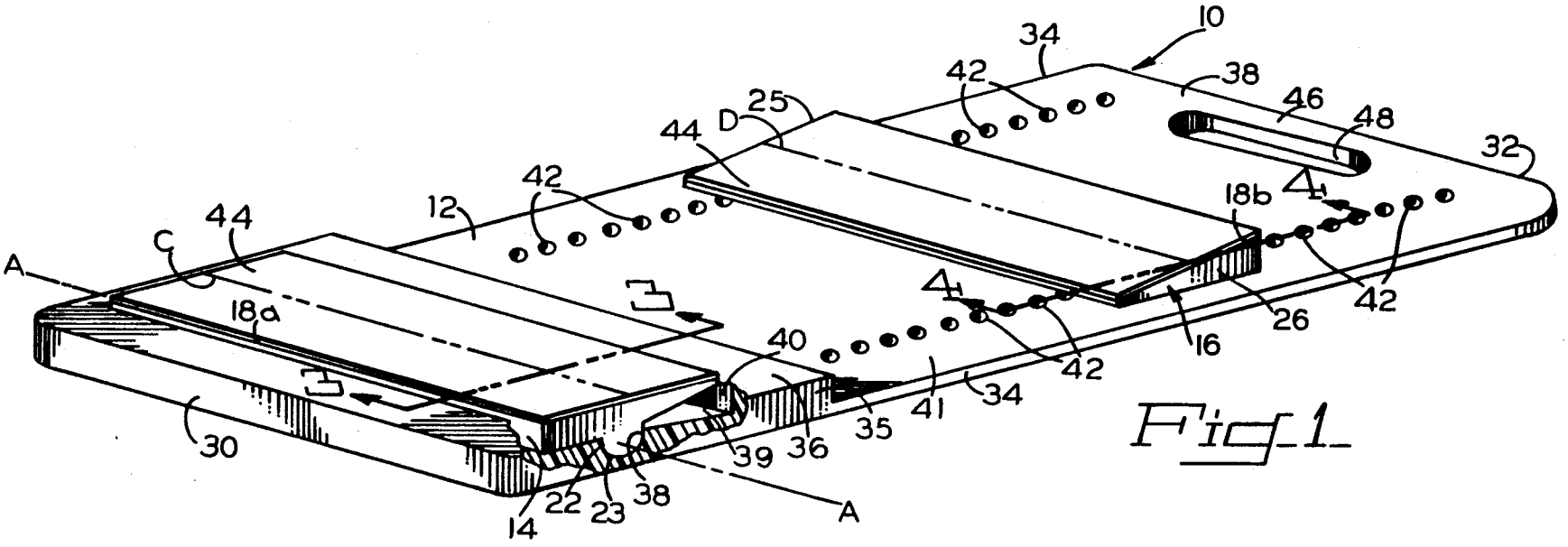
FIG. 1 is a perspective view of a preferred embodiment of the training device.

A preferred embodiment for the golf training device of this invention is illustrated in the drawing FIGS. 1-4. The training device is generally indicated as 10 in FIGS. 1, 3 and 4. Referring first to the view of FIG. 1, it can be seen that the training device 10 comprises a base 12, a first foot pad 14 and a second foot pad 16. As seen in FIGS. 3 and 4, each foot pad 14 and 16 further comprises a support surface 18*a* and 18*b* respectively, and an opposed bottom 20*a* and 20*b* respectively. The support surfaces 18*a* and 18*b* of foot pads 14 and 16 respectively each have respective center lines C and D as shown in FIG. 1. The foot pads 14 and 16 are supported on the base such that the respective center lines C and D are generally in the same plane and are generally parallel to one another.

In the preferred embodiment the first foot pad 14 has a longitudinal axis A and further comprises a projection 22 with an end 23 distal the foot pad 14 that extends outwardly from the bottom 20*a* and lies along the longitudinal axis A. In the preferred embodiment the projection extends the full length of the first foot pad 14, but in other embodiments it may comprise a plurality of short portions or nubs. The first foot pad 14 further comprises a biasing means, conveniently spring 24, that extends downwardly from the bottom 20*a*.

The second foot pad 16 is formed such that the support surface 18*b* lies at a predetermined angle B to the base 12, as seen in FIG. 4, forming a wedged-shaped foot pad. The second foot pad 16 has a first end 25 and a second end 26. In the preferred embodiment, and as best seen in FIGS. 1 and 4, a row of three pegs 28 projects downwardly from the bottom 20*b* of the second foot pad 16 generally parallel and proximal to the first end 25. A row of three pegs 28 projects downwardly in a similar fashion, generally parallel and proximal to the second end 26. The two rows of three pegs 28 are generally parallel to one another.

As shown in FIG. 1, in the preferred embodiment, the base 12 is generally rectangular having a width greater than the length of the first and second foot pads 14 and 16, and a length longer than the widest spacing between the first foot pad 14 and the second foot pad 16 necessary to support the widest stance to be taken by a golfer on the training device 10. However, in other embodiments the base 12 may be any shape or size that is sufficient to support the foot pads. The base 12 has a first end 30, a second end 32, and opposing sides 34. The base 12 further comprises a raised portion 35 extending from the first end 30 toward the second end 32. The top 36 of the raised portion 35 of the base 12 has a recess 37 therein sized to receive the first foot pad 14. In the preferred embodiment, as shown in FIGS. 1 and 3, a groove 38 extends longitudinally in the bottom surface 39 of the recess 37, generally centered between the opposing longitudinal walls 40 of the recess 35 and thus generally parallel to the first end 30 and normal to the opposing sides 34 of the base 12. The groove 38 is sized and configured to receive the distal end 23 of the projection 22 of the first foot pad 14. As can be seen in FIG. 3, when the projection 22 is received by groove 38 the first foot pad 14 is rotatable about the projection 22, and about axis A, from a horizontal position to an inwardly-facing position, as shown in phantom, in relation to the second foot pad 16. The bottom surface 39 of the recess 37 is sloped inwardly to permit increased rotation of the first foot pad 14. The spring 24 biases the first foot pad to the horizontal position by engagement with the bottom surface 39 of the recess 37. In the preferred embodiment the biasing means comprises a spring 24 attached to the bottom 20*a* of foot pad 14, in other embodiments the biasing means may be attached to the base 12 and/or may be comprised of resilient material well known in the art. While in the preferred embodiment the projection 22 and the groove 38 create a means for rotating the first foot pad 14 about axis A, other means well known in the art, including but not limited to, axles and hinges may be successfully used.

The base 12 further comprises two rows of holes 42 formed in the top 41 of the base 12. One row of holes 42 is proximal to one of the sides 34 and the other row of holes is proximal to the opposing side 34. The two rows of holes 42 are generally parallel to one another and spaced apart so that each row of pegs 28 may be aligned with any combination of three adjacent holes 42 in a corresponding row of holes 42. The holes 42 are sized and configured to receive the pegs 28, and because there are a plurality of holes extending longitudinally of the base 12 the second foot pad 16 may be mounted on the base in a plurality of positions from a position distal the first foot pad 14 to a position proximal to the first foot pad 14.

A mat 44, which in the preferred embodiment is made of a polyvinyl material, is attached to the support surfaces 18*a* and 18*b* . However, in other embodiments the mats 44 may be of other elastomers or may be of fibrous material to simulate grass and/or to accommodate the spikes of a golf shoe. In other embodiments, the support surfaces 18*a* and 18*b* may be recessed to receive the mats 44.

In the preferred embodiment, as can be seen in FIG. 1, a handle 46 is formed by aperture 48 that passed through the base 12 proximal to the second end 32, the aperture 48 being sized to receive a person's hand.

In the preferred embodiment, the training device is constructed from a generally rigid synthetic resin that may be molded to the proper form utilizing methods well known in the art. In other embodiments, the device could be constructed from metal, wood or any other practical material suitable for the purpose.

Having thus set forth a preferred construction for the training device 10 of this invention, it is to be remembered that this is but a preferred embodiment. Attention is now invited to a description of the use of the training device 10. The training device 10 is portable and may be placed outdoors at a driving range or indoors for reinforcement training purposes. If used outdoors at a driving range, the device is aligned with a target down range to help a golfer see his proper alignment with the target. The second foot pad 16 is adjusted to the appropriate stance width, the distance between the center line C of the first foot pad 14 and the center line D of the second foot pad 16. If the golfer is right-handed, the golfer will place his left foot on the first foot pad 14 and his right foot on the second foot pad 16. A left-handed golfer, of course, would place his right foot on foot pad 14 and his left foot on foot pad 16. In both cases, however, the lead foot (the foot closest to the target) will be on pad 14 and the back foot will be on pad 16. The golfer, holding a club using the proper grip, will place the club in the set-up position preparatory to a swing. The golfer will then commence the back swing. As the golfer moves the club into the back swing, he will shift his weight from his lead foot toward his back foot and as this happens the left foot pad 14 will rotate inwardly forcing the golfer's left knee inward and forcing a further transfer of weight toward the rear foot. The weight that remains on the lead foot will now ride on the inside of the ball of the left foot. The wedge-shaped form of the second foot pad 16 forces the right knee to remain bent slightly inwardly and discourages the golfer from transferring his weight beyond the inside portion of the right foot. Transfer of weight beyond the inside of the right foot results in body sway and improper alignment of the club during the swing. A the golfer's begins the forward swing the lead foot is rotated on the first foot pad 14 to the horizontal position initiating the weight transfer to the lead foot. The golfer then pushes off the angled second foot pad 16 with his rear foot to complete the weight transfer as the forward swing is completed. The second foot pad 16 is slanted inwardly so that the golfer's weight will remain on the inside of the back foot. Use of the device allows the golfer to experience what the proper weight shift feels like. In addition, through repetition, the proper movement of the lower body to obtain a proper weight shift can be ingrained in the subconscious so that it is virtually an automatic series of movements that will be repeated by the golfer when he is no longer standing on the training device.

It will thus be seen that the objects set forth above, among those made apparent from the proceeding description, are efficiently attained and, since certain changes may be made in the above article without departing from the scope of the invention, it is intended that all matter contained in the above description or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A training device for golfers comprising:

a base; and a first foot pad operatively supported on said base said first foot pad having a longitudinal axis and a support surface;

a second foot pad supported on said base in spaced-apart relation from said first food pad, at least one of said foot pads being movable in relation to said base, toward or away from said other foot pad, said second foot pad having a support surface, said support surface of said second foot pad having a predetermined angle greater than zero degrees in relation to said base; and said first foot pad comprising a means for rotating said first foot pad about said longitudinal axis such that said support surface is rotatable only between a generally horizontal position and an inwardly-facing position in relation to said second foot pad.

2. A device as in claim 1 wherein said support surface of said second foot pad faces inwardly in relation to said first foot pad.

3. A device as in claim 1 wherein said second foot pad further comprises a first end and a second end, at least one peg extending downwardly from said foot pad proximal to said first end and at least one peg extending downwardly from said foot pad proximal to said second end, said base having a plurality of holes therein said holes being sized and configured to receive one said peg such that said second foot pad may be mounted to said base.

4. A device as in claim 1 wherein said first foot pad further comprises a bottom opposed to said support surface and wherein said means for rotating said first foot pad comprises a projection extending outwardly from said bottom, said projection having an end distal said foot pad, said distal end being generally coincident with said longitudinal axis of said first foot pad, said base comprising a groove therein sized and configured to receive said distal end of said projection such that said first foot pad rotates about said distal end.

5. A device as in claim 1 wherein said base further comprises a recessed portion that receives at least a portion of said first foot pad.

6. A device as in claim 1 wherein said first foot pad is substantially parallel to said second foot pad.

7. A device as in claim 1 further comprising a pair of mats, one said mat supported on said support surface of each said foot pad.

8. A device as in claim 1 wherein said base comprises a handle means, by which said device may be transported from one place to another.

9. A device as in claim 8 wherein said base comprises four edges, a top surface and a bottom surface, and said handle means comprises an aperture extending through said base from said top surface through said bottom surface proximal one said edge of said base, said edge of said base adjacent said aperture forming a handle.

10. A device as in claim 1 wherein said first foot pad further comprises a biasing means interposed between said first foot pad and said base such that said biasing means urges said first foot pad to rotate so that said support of said first foot pad is in said generally horizontal position.

11. A device as in claim 10 wherein said biasing means comprises a spring.

* * * * *